United States Patent [19]

Yahagi et al.

[11] Patent Number: 4,984,274

[45] Date of Patent: Jan. 8, 1991

[54] SPEECH RECOGNITION APPARATUS WITH MEANS FOR PREVENTING ERRORS DUE TO DELAY IN SPEECH RECOGNITION

[75] Inventors: Mitsuhisa Yahagi, Akishima; Nobuyuki Tonegawa, Kawasaki, both of Japan

[73] Assignee: Casio Computer Co., Ltd., Tokyo, Japan

[21] Appl. No.: 372,868

[22] Filed: Jun. 28, 1989

[30] Foreign Application Priority Data

Jul. 7, 1988 [JP] Japan ..... 63-90337[U]
Jul. 7, 1988 [JP] Japan ..... 63-90341[U]

[51] Int. Cl.[5] ..... G10L 7/08
[52] U.S. Cl. ..... 381/43
[58] Field of Search ..... 381/41–46, 381/110; 364/513.5, 705.07; 367/198; 368/63, 72–73

[56] References Cited

U.S. PATENT DOCUMENTS 4,158,750 6/1979 Sakoe et al. ..... 381/43
4,408,096 10/1983 Washizuka et al. ..... 364/513.5
4,461,023 7/1984 Katayama ..... 381/43
4,509,133 4/1985 Monbaron et al. ..... 364/513.5
4,532,648 7/1985 Noso et al. ..... 381/41
4,573,187 2/1986 Bui et al. ..... 381/43
4,596,031 6/1986 Hakaridani et al. ..... 381/43
4,635,286 1/1987 Bui et al. ..... 381/43

*Primary Examiner*—Dale M. Shaw
*Assistant Examiner*—John Merecki
*Attorney, Agent, or Firm*—Frishauf, Holtz, Goodman & Woodward

[57] ABSTRACT

When a speech sound of at least a predetermined sound pressure is externally input while a time measurement is not being performed, a time measuring circuit starts a time measurement responsive to a signal from a speech detector. When another speech sound of at least a predetermined sound pressure is externally input while a time measurement is being performed by the time measuring circuit, a measurement time measured by the time measuring circuit at this moment is stored in a time information memory. After a predetermined time has elapsed, if a speech recognition circuit recognizes that the externally input speech sound is a "stop" command, the time measurement operation performed by the time measuring circuit is stopped, and the time information stored in the time information memory is read out and displayed as measurement time information on a display unit.

18 Claims, 12 Drawing Sheets

SPEECH RECOGNITION APPARATUS WITH MEANS FOR PREVENTING ERRORS DUE TO DELAY IN SPEECH RECOGNITION

BACKGROUND OF THE INVENTION

1. Field of the Invention

The present invention relates to a speech recognition apparatus for recognizing input speech data and performing an operation according to the recognition result.

2. Description of the Related Art

When a conventional speech recognition apparatus incorporated in an electronic instrument or the like receives a speech input, the apparatus recognizes speech data of the input speech over a predetermined time and starts a predetermined operation in accordance with the recognition result after recognition is finished.

Speech recognition techniques of this type are described in, for example, U.S. Pat Nos. 4,158,750, 4,461,023, 4,532,648 and 4,596,031.

When the above conventional speech recognition apparatus is incorporated in, e.g., a stopwatch device or timer device to control start or stop of a time measurement operation in accordance with a speech such as "start" or "stop", the following problem arises. That is, in a track or swimming race, for example, assume that racers or swimmers start in accordance with a speech "start" and a stopwatch device recognizes the speech "start" and then starts time measurement. In this case, the competitors start not after the speech "start" is completely finished but simultaneously with start of the speech "start". The stopwatch device, however, starts the time measurement after the speech "start" is completely input and recognized. Therefore, since a time difference is produced between the start of the competitors and that of time measurement of the stopwatch device, a correct measurement time cannot be obtained. This problem is similarly posed, as in the case of "start", when measurement is to be stopped by a speech "stop" or elapsed time data is to be obtained by a speech such as "lap" or "split".

When the speech recognition apparatus is incorporated in a video tape recorder or speech recording device to start or stop video or sound recording by a speech sound, the same problem as in the case of the stopwatch device arises. In addition, for example, in a system in which different data are automatically and selectively displayed on a screen at a predetermined time interval and desired data can be held on the screen by a speech sound of "stop" when it is displayed on the screen, the same problem is posed.

SUMMARY OF THE INVENTION

The present invention has been made in consideration of the above conventional problem and has as its object to provide a speech recognition apparatus capable of eliminating a time difference upon speech recognition to perform a correct operation.

In order to achieve the above object of the present invention, there is provided a speech recognition apparatus comprising:

speech input means for externally inputting a speech;

first control means, connected to the speech input means, for performing a predetermined operation when the speech is input;

speech recognizing means, connected to the speech input means, for recognizing the input speech; and second control means, connected to the speech recognizing means, for performing an operation different from the predetermined operation performed by said first control means on the basis of a recognition result obtained by the speech recognizing means.

With the above arrangement, the present invention has an effect of correctly performing time measurement or data search in accordance with speech recognition.

DETAILED DESCRIPTION OF THE PREFERRED EMBODIMENTS

Embodiments of the present invention will be described in detail below with reference to the accompanying drawings.

1st Embodiment

Figure 1:
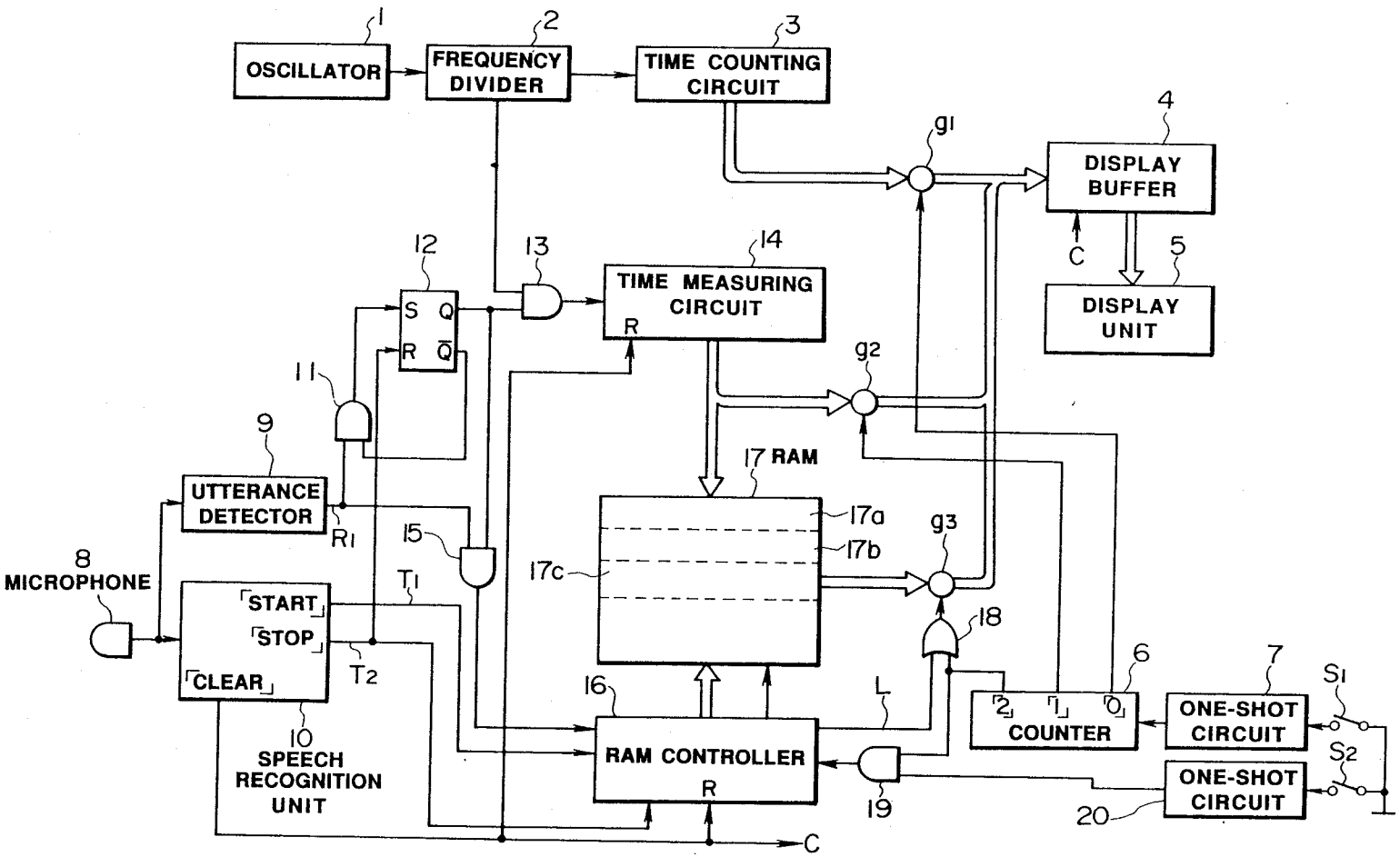
FIG. 1 is a block diagram showing an internal circuit of a stopwatch device adopting a speech recognition apparatus of the present invention.

FIG. 1 is a block diagram showing an internal circuit of a stopwatch device adopting the present invention.

Referring to FIG. 1, oscillation clock pulses output from an oscillator 1 are frequency-divided by a frequency divider 2 into count signals having, e.g., a 1-sec period and input to a time counting circuit 3. The time counting circuit 3 counts the count signals and outputs current time data including "hour", "minute", "second", and the like. When a gate g1 is enabled, the current time data is displayed on a digital display unit 5 via a display buffer 4. The gate g1 and two other gates g2 and g3 are enabled when the contents of a ternary counter 6 are "0", "1", and "2", respectively. The current time data, measurement time data of a time measuring circuit 14 to be described later, and split time data (data representing an elapsed time from start of measurement) of a RAM 17 to be described later are displayed on the display unit 5 via the display buffer 4 when the gates g1, g2, and g3 are enabled, respectively. The counter 6 counts a one-shot pulse output from a one-shot circuit 7 each time an operation switch S1 for switching the display is operated. Therefore, switching of the display of the above data is performed by operating the switch S1 for display switching.

Reference numeral 8 denotes a microphone for inputting speech. A speech input from the speech inputting microphone 8 is detected by an utterance detector 9, and input speech data is supplied to a speech recognition unit 10. When the utterance detector 9 detects that a sound pressure of the input speech exceeds a predetermined level, it outputs a high-level one-shot detection signal R1. The signal R1 is supplied to the set input terminal S of a flip-flop 12 via an AND gate 11 for receiving a $\overline{Q}$ output from the flip-flop 12 which keeps the high level except when measurement is performed by the measuring circuit 14 to be described later. The Q output from the flip-flop 12 is supplied to an AND gate 13 together with a count signal of a predetermined period, e.g., a 100 Hz signal from the frequency divider 2. Clock signals output from the AND gate 13 are counted by the measuring circuit 14. That is, when a speech is input during a stop state in which the $\overline{Q}$ output from the flip-flop 12 is at high level, the signal R1 from the speech detector 9 is supplied to the flip-flop 12 via the AND gate 11. Therefore, the Q output from the flip-flop 12 goes to high level, and the measuring circuit 14 starts counting of the 100 Hz signals.

The Q output from the flip-flop 12 is also supplied to an AND gate 15 which receives the detection signal R1 output each time the detector 9 detects a speech sound. An output signal from the AND gate 15 is supplied to a RAM controller 16. Each time the RAM controller 16 receives the detection signal R1 from the AND gate 15, it stores measurement time data from the measuring circuit 14 in an address area designated from a plurality of data memory areas 17*a*, 17*b*, . . . , of a RAM 17 and designates the next memory area. That is, when a speech sound is input from the microphone 8 and detected by the detector 9 while the Q output from the flip-flop 12 is at high level and the measuring circuit 14 performs a measurement, the contents of the circuit 14 at this moment are sequentially stored in memory areas of the RAM 17 designated by the RAM controller 16.

The speech signal from the microphone 8 is also supplied to the speech recognition unit 10 to start speech recognition. After a predetermined time has elapsed, speech recognition is completed. The following processing is executed on the basis of whether the recognition result represents "start", "stop", "clear", or "split".

When the input speech is recognized as "start", the unit 10 outputs a recognition signal T1 to the RAM controller 16. When the controller 16 receives the recognition signal T1, it designates an address of a first memory area 17*a*.

When the input speech is recognized as "stop", the unit 10 outputs a recognition signal T2 as a reset signal to the flip-flop 12. As a result, the Q output from the flip-flop 12 goes to low level to disable the AND gate 13, thereby finishing time measurement by the measuring circuit 14. Since the signal T2 is also supplied to the RAM controller 16, measurement data stored lastly as a split time in the RAM 17, i.e., data of the circuit 14 stored in the RAM 17 when the speech "stop" is input is read out. At the same time, a signal L is supplied from the controller 16 to the gate g3 via an OR gate 18 to enable the gate g3. As a result, the last split time data, i.e., the time data stored when the speech "stop" is generated, passes through the gate g3 and is displayed on the display unit 5 via the display buffer 4. Therefore, when a speech "stop" is input, measurement data at this moment is stored as a split time in the RAM 17, and the measuring circuit 14 continues time measurement until the recognition signal T2 is output. After recognition of the speech "stop" is completed, the measurement is finished, and the split time stored in the RAM 17 upon inputting of the speech "stop" is displayed as a final measurement time of this stop processing.

When the speech is recognized as "clear", all the contents in the measuring circuit 14, the RAM controller 16, and the display buffer 4 are cleared.

FIGS. 2A to 2E show timing charts of the circuits shown in FIG. 1.

Figures 2A, 2B, 2C, 2D, 2E:
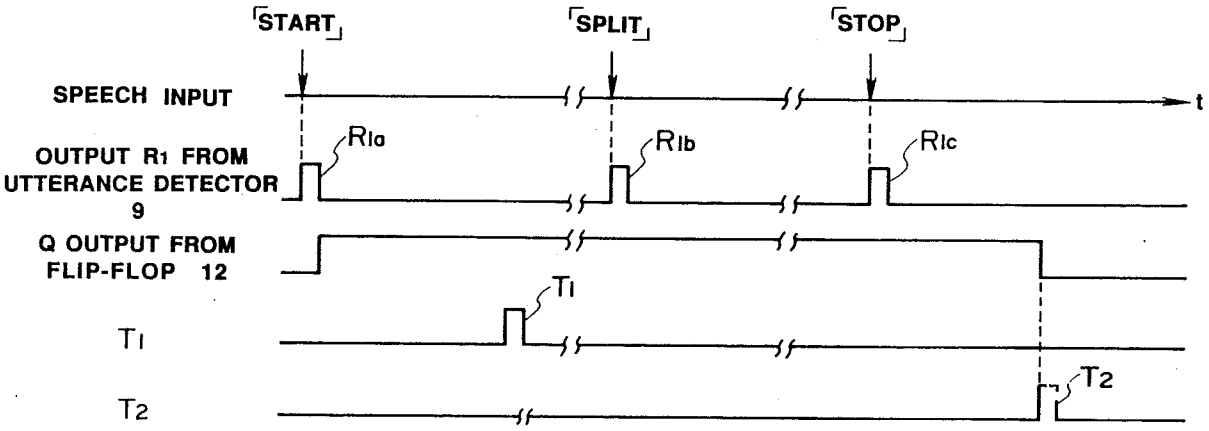
FIGS. 2A to 2E are timing charts for explaining an operation of the embodiment shown in FIG. 1.

Whenever a speech such as "start", "split", or "stop" is input as shown in FIG. 2A, the utterance detector 9 outputs the signal R1 as shown in FIG. 2B, and the contents of the measuring circuit 14 are stored in the RAM 17.

When the Q output from the flip-flop 12 shown in FIG. 2C is at low level, the $\overline{Q}$ output from the flip-flop 12 is at high level. At this time, if a speech is input, the signal R1 from the utterance detector, i.e., a first signal R1a shown in FIG. 2B is output via the AND gate 11 to set the Q output from the flip-flop 12 at high level, thereby starting time measurement by the circuit 14.

Thereafter, when the speech recognition unit 10 recognizes that the input speech is "start", the recognition signal T1 is supplied to the RAM controller 16, and the controller 16 designates the address of the first memory area 17*a* of the RAM 17. When the Q output of the flip-flop 12 is at high level, time measurement is started by a speech other than "start". When a speech other than "start" is input, although time measurement is not an object of the speech, start of the time measurement is not problematic at all. If a stopwatch must be used during the time measurement, speech "stop" and "clear" need only be input.

After time measurement is started as described above, speech inputs other than "stop" or "clear" are considered as a speech input of "split". At the same time a speech "split" is input, a signal R1b shown in FIG. 2B is supplied to the RAM controller 16 via the AND gate 15 to store a split time measured by the measuring circuit 14 in a designated memory area of the RAM 17 and to designate the next memory area in the RAM 17.

When the input speech is "stop", time data of the measuring circuit 14 obtained when the speech "stop" is input is stored in the RAM 17 as represented by R1c in FIG. 2B, and the circuit 14 continues time measurement until the recognition signal T2 representing "stop" shown in FIG. 2E is output. When the signal T2 is output, however, since this signal causes the display unit 5 to display the time data output from the circuit 14 and stored in the RAM 17, an operator can check the time data obtained when the speech "stop" is generated.

When the content of the counter 6 is switched to "2", the gate g3 is enabled via the OR gate 18, and the content is also supplied to the AND gate 19. At this time, each time the switch S2 is operated, a one-shot pulse is output from the one-shot circuit 20 to the RAM controller 16 via an AND gate 19. The controller 16 sequentially designates an address of the RAM 17 and reads out split time data each time the above pulse is input. The sequentially readout split time data are supplied through the gate g3 and displayed on the display unit 5 via the display buffer 4.

As described above, according to this embodiment, when the utterance detector 9 detects a speech while the measuring circuit 14 does not perform time measurement, time measurement is immediately performed assuming that the speech is "start". Therefore, no time difference is produced.

When a speech is detected during time measurement by the circuit 14, time data at this moment is immediately stored assuming that the speech is "split". Therefore, in the case of "split", no time difference is produced. When a speech is not "split" but "stop", a time difference is corrected because correction is performed when recognition of "stop" is finished. Therefore, a correct stop time is obtained.

In the above embodiment, a time from measurement start is stored and displayed as "split". By using a speech "lap" in place of "split", a time interval between preceding and current "lap" speech may be stored and displayed.

2nd Embodiment

Figure 3:
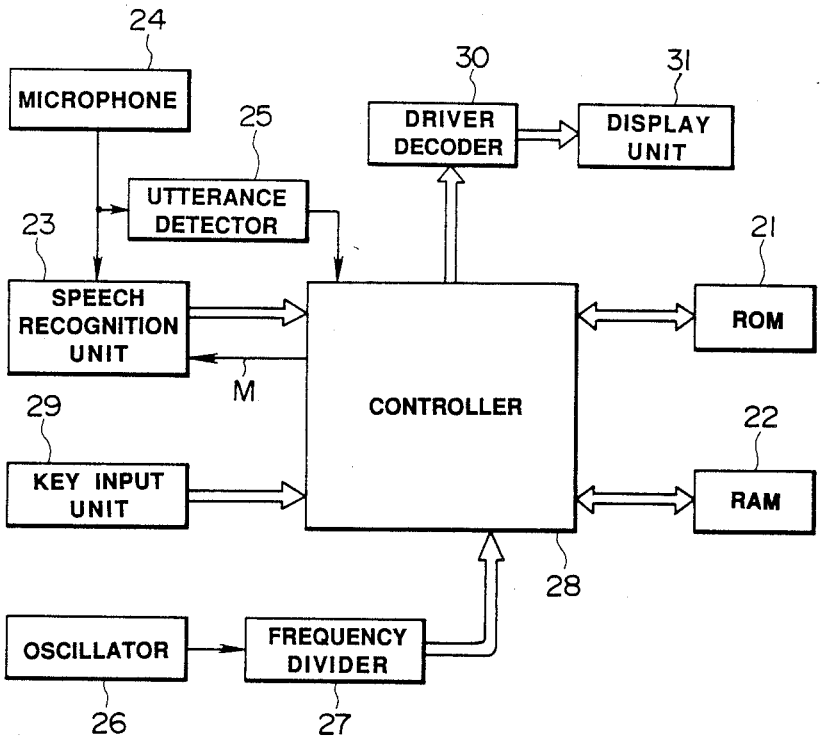
FIG. 3 is a block diagram showing an internal circuit of a data memory device according to a second embodiment of the present invention.

FIG. 3 is a block diagram showing internal circuits of a data memory device according to a second embodiment of the present invention.

Figure 4:
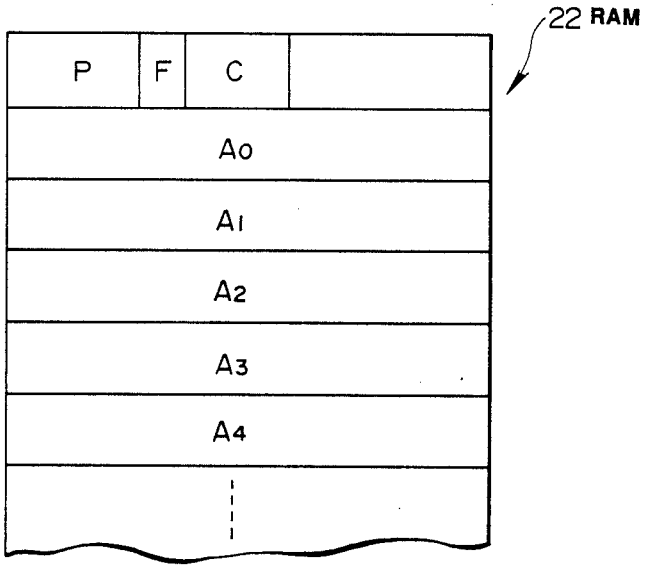
FIG. 4 is a diagram showing the contents of a RAM 22 according to the embodiment shown in FIG. 3.

Referring to FIG. 3, a ROM 21 is a read-only memory which stores microprograms and data for controlling the entire system. A RAM 22 is a random access memory used for data read/write of various data and including various registers shown in FIG. 4. A large number of data memories A0, A1, . . . are memories for storing item data including a plurality of characters and numerals such as name and telephone number data or date, time, and schedule data. Page pointer P designates an address (page) of one of the above data memories. "1" is written in a search flag F during data search and "0" is written therein upon completion of search. A counter C counts a 32 Hz count signal or a 32 Hz count signal offset therefrom by a half period.

Referring to FIG. 3, a speech recognition unit 23 recognizes speech data input from a microphone 24. An utterance detector 25 detects that a speech having a predetermined volume or more is input. An oscillator 26 outputs a clock signal of a predetermined period. A frequency divider 27 frequency-divides the above clock signal and outputs a count signal of a predetermined period (e.g., 1/32 sec).

A controller 28 is an arithmetic circuit for performing speech processing corresponding to outputs from the speech recognition unit 23 and the utterance detector 25 or key input processing corresponding to a key input from a key input unit 29 on the basis of the programs stored in the ROM 21. Various data obtained by these processing operations are displayed on a dot-matrix display unit 31 by a driver decoder 30.

Speech processing and accompanied display processing performed by the data memory device shown in FIG. 3 upon data search will be described.

Figure 5:
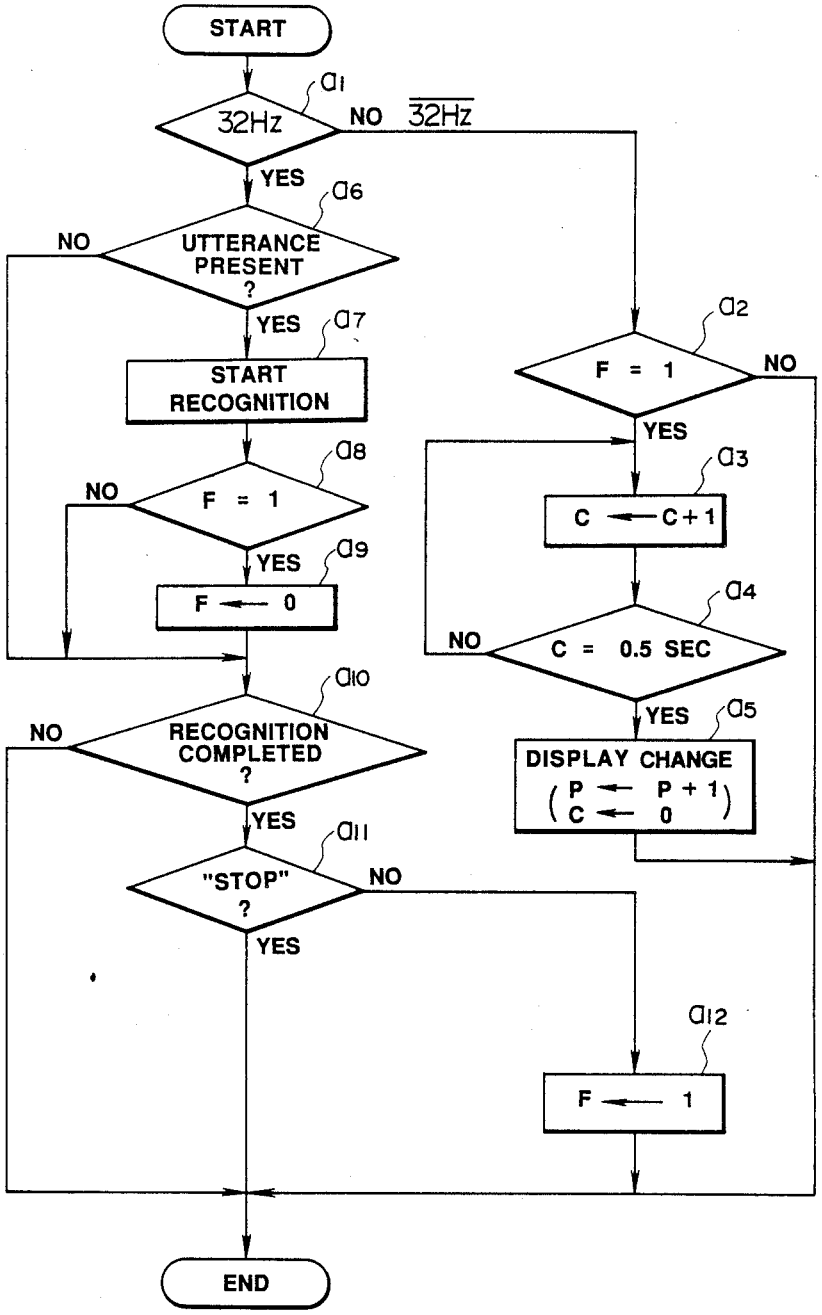
FIG. 5 is a flow chart for explaining in detail the speech processing of the embodiment shown in FIG. 3.
Figure 6:
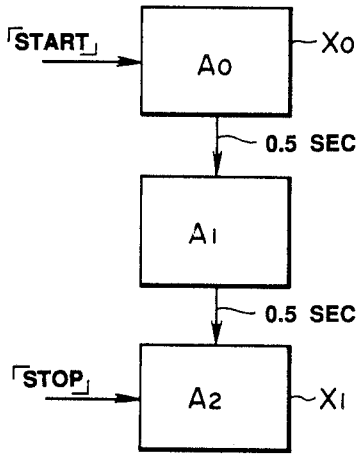
FIGS. 6 and 7 are views showing switching of display according to a speech input upon data search of the embodiment shown in FIG. 3.

FIG. 6 shows a display state change in the display unit 31. For example, as indicated by X0 shown in FIG. 6, assume that name and telephone number data stored in the memory area A0 of the RAM 22 is displayed on the display unit 31. In this state, in order to search another name and telephone number, a speech "start" is input. FIG. 5 is a flowchart for explaining an operation performed upon input of the speech. In step $a_1$, whether a 32 Hz signal is input is checked. In step $a_6$, whether a speech is input is checked by the utterance detector 25. These checking operations are performed on the basis of whether the input speech has a sound pressure of a predetermined level or more. When the speech "start" is input as described above, the utterance detector 25 immediately outputs a signal. Therefore, this is determined in step $a_6$, and the flow advances to step $a_7$. In step $a_7$, a signal M, in FIG. 3, is supplied to the speech recognition unit 23 to start a speech recognizing operation. In step $a_8$, whether F is 1, i.e., whether a search operation is being performed is checked. At this time, since data search is not started yet, the flow advances to step $a_{11}$, and a determining operation for checking whether the recognizing operation is completed is executed. Since the recognizing operation requires several seconds before completion, however, recognition is not completed yet at this moment, and the flow is ended. When a 32 Hz signal is output thereafter, the flow is ended through steps $a_1$, $a_6$, and $a_{10}$ without executing any processing operation. When the 32 Hz signal is output, the flow is ended through steps $a_1$ and $a_2$. Therefore, display contents are not changed at all in either case. At a timing at which the 32 Hz signal is output and recognition completion is determined in step $a_{10}$, whether the speech is "stop" is checked in step $a_{11}$. Since the input speech is "start", the flow advances to step $a_{12}$, and "1" is set in the flag F. When "1" set in the flag F, this is detected in step $a_2$ each time the 32 Hz signal is input, and the counter C counts the 32 Hz signals in step $a_3$. When it is determined in step a40 that the content of the counter C is 0.5 seconds, display change processing is performed in step $a_5$. In this processing, the page pointer P is incremented by one, and the content in the counter C is reset to be zero. Therefore, during data search, the content of the pointer P is incremented by one each time the counter C counts 0.5 seconds, and the contents in the data memories A0, A1, . . . are sequentially displayed as shown in FIG. 6.

When a speech is input at a timing at which the 32-Hz count signal is input in step $a_1$ while the display is switched every 0.5 seconds, whether a speech is input is checked in step $a_6$. If a speech is input, speech recognition is started in step $a_7$. Subsequently, whether F=1 (i.e., whether data search is being performed) is checked in step $a_8$. If F=1 in step $a_8$, "0" is set in the flag F in step $a_9$. That is, the input speech is determined to be "stop", and data search is temporarily stopped.

Thereafter, when speech recognition is completed, it is checked in step $a_{11}$ whether the recognition result is "stop" for stopping data search. If "stop" is determined in step $a_{11}$, the processing is ended. Therefore, if a speech "stop" is input during data search, search is immediately finished, and data displayed at this moment is still-displayed. For example, if the speech "stop" is input while the content of the data memory A2 is displayed as indicated by X1 in FIG. 6, search is immediately stopped, and the content of the data memory A2 is kept displayed.

Figure 7:
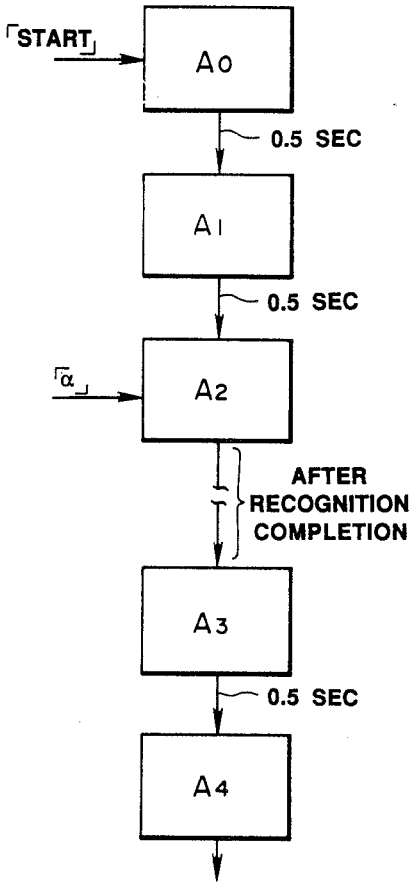

If it is determined in step $a_{11}$ that the speech is not "stop" (e.g., the speech is other than "start" and "stop"), the content of the search flag F is reset to "1" in step $a_{12}$. That is, if "stop" is determined to set F=0 in step $a_9$, F=1 is reset when the recognition result is not "stop", and data search is started (restarted). For example, as shown in FIG. 7, when a speech (to be referred to as "c" hereinafter) other than "stop" is input while the content of the data memory A2 is displayed, data search is temporarily stopped, and the content of the data memory A2 is kept displayed. After a recognition time has elapsed, however, search is restarted.

According to the second embodiment shown in FIGS. 3 to 7, as described above, when a certain speech is input, the input speech is determined to be "stop" to temporarily stop search. If the speech recognition result obtained thereafter is other than "stop", correction based on the recognition result is performed, i.e., search is restarted. Therefore, since no time difference is produced between the display data upon speech input and completion of speech recognition, data search is correctly performed in accordance with a speech input.

3rd Embodiment

Figure 8:
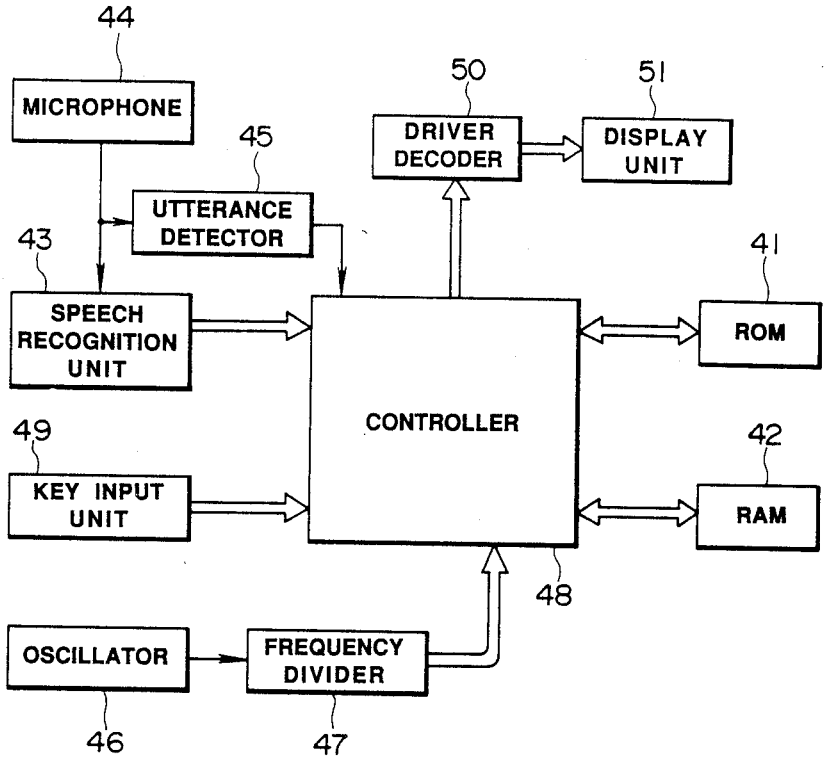
FIG. 8 is a block diagram showing an internal circuit of a stopwatch device according to a third embodiment of the present invention.

FIG. 8 is a block diagram showing internal circuits of a stopwatch device according to a third embodiment of the present invention.

Figure 9:
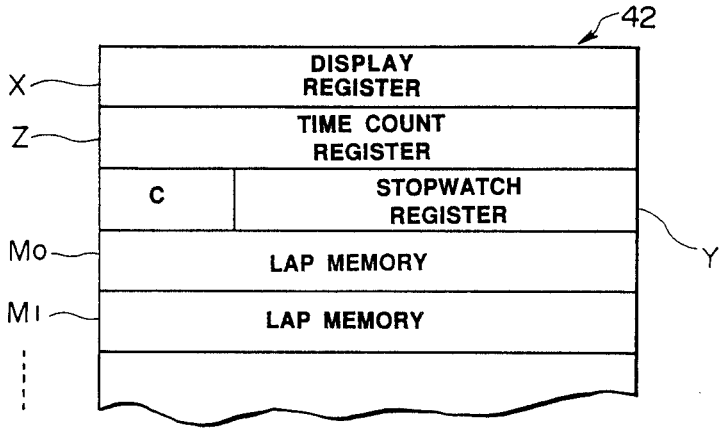
FIG. 9 is a diagram showing the contents of a RAM 42 shown in FIG. 8.

Referring to FIG. 8, a ROM 41 is a read-only memory storing microprograms and data for controlling the entire system. A RAM 42 is a memory for data read/-write of various data and includes various memory areas as shown in FIG. 9. Referring to FIG. 9, a display register X, a stopwatch register Y, and a time count register Z store data displayed on a display unit 51 to be described later, measurement data upon stopwatch operation, and time data representing a current time, respectively. A plurality of lap memories M0, M1, . . . sequentially store lap data upon stopwatch operation. A register C starts counting when a speech is input and stops counting when speech recognition is finished, as will be described in detail later.

Referring to FIG. 8, a speech recognition unit 3 recognizes speech data input from a microphone 44. An utterance detector 45 detects that a speech having a predetermined sound pressure or more is input from the microphone 44. An oscillator 46 outputs a clock signal of a predetermined period. A frequency divider 47 frequency-divides the above clock signal and outputs a count signal of a predetermined period (e.g., 1/32 sec).

A controller 48 is an arithmetic circuit for performing speech processing corresponding to outputs from the speech recognition unit 43 and the utterance detector 45, key input processing corresponding to a key input from a key input unit 49, and count processing corresponding to the count signal from the frequency divider 47, on the basis of the programs stored in the ROM 41. Time data, stopwatch data, and the like obtained by the above processing operations are displayed on a display unit 51 by a decoder driver 50.

Figure 10:
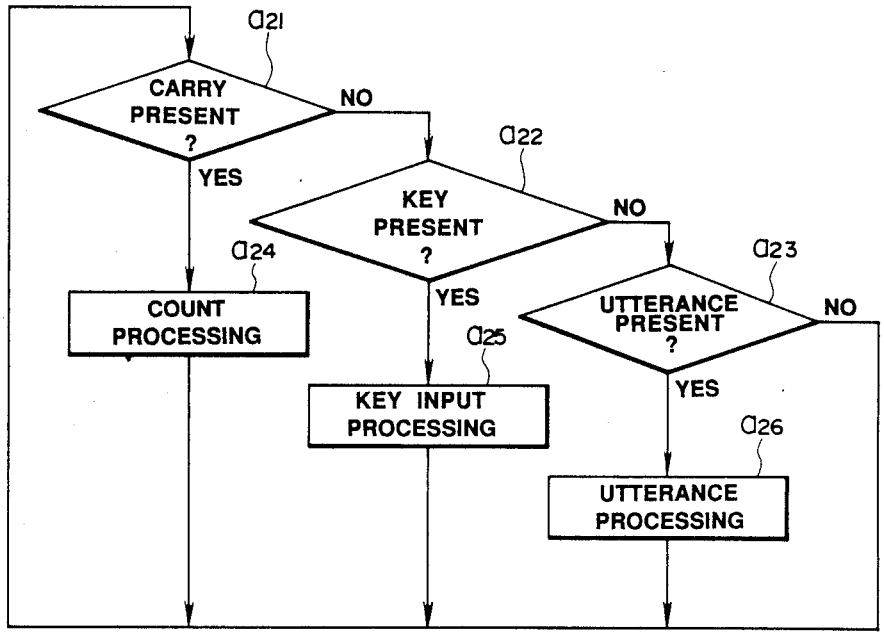
FIG. 10 is a flow chart for explaining overall processing of the embodiment shown in FIG. 8.

FIG. 10 is a general flowchart showing the overall processing controlled by the controller 48 in accordance with the programs stored in the ROM 41.

Referring to FIG. 10, in steps $a_{21}$ to $a_{23}$, operations are performed to check whether a count carry signal from the frequency divider 47, a key input from the key input unit 49, and a speech input from the microphone 44 (speech detection of the utterance detector 45) are present, respectively. If it is determined in step $a_{21}$ that a count carry signal is present, count processing is performed in step $a_{24}$. In this count processing, current time data or stopwatch data including hour, minute, second, or the like is counted on the basis of the count carry signal. If it is determined in step $a_{22}$ that a key input is present, key input processing is performed in step $a_{25}$. The key input processing corresponds to various keys (e.g., a mode switching key and a time correction key) operated by the key input unit 49. If it is determined in step $a_{23}$ that a speech input is present, speech processing is performed in step $a_{26}$. The speech processing will be described in detail with reference to FIG. 11.

Figure 11:
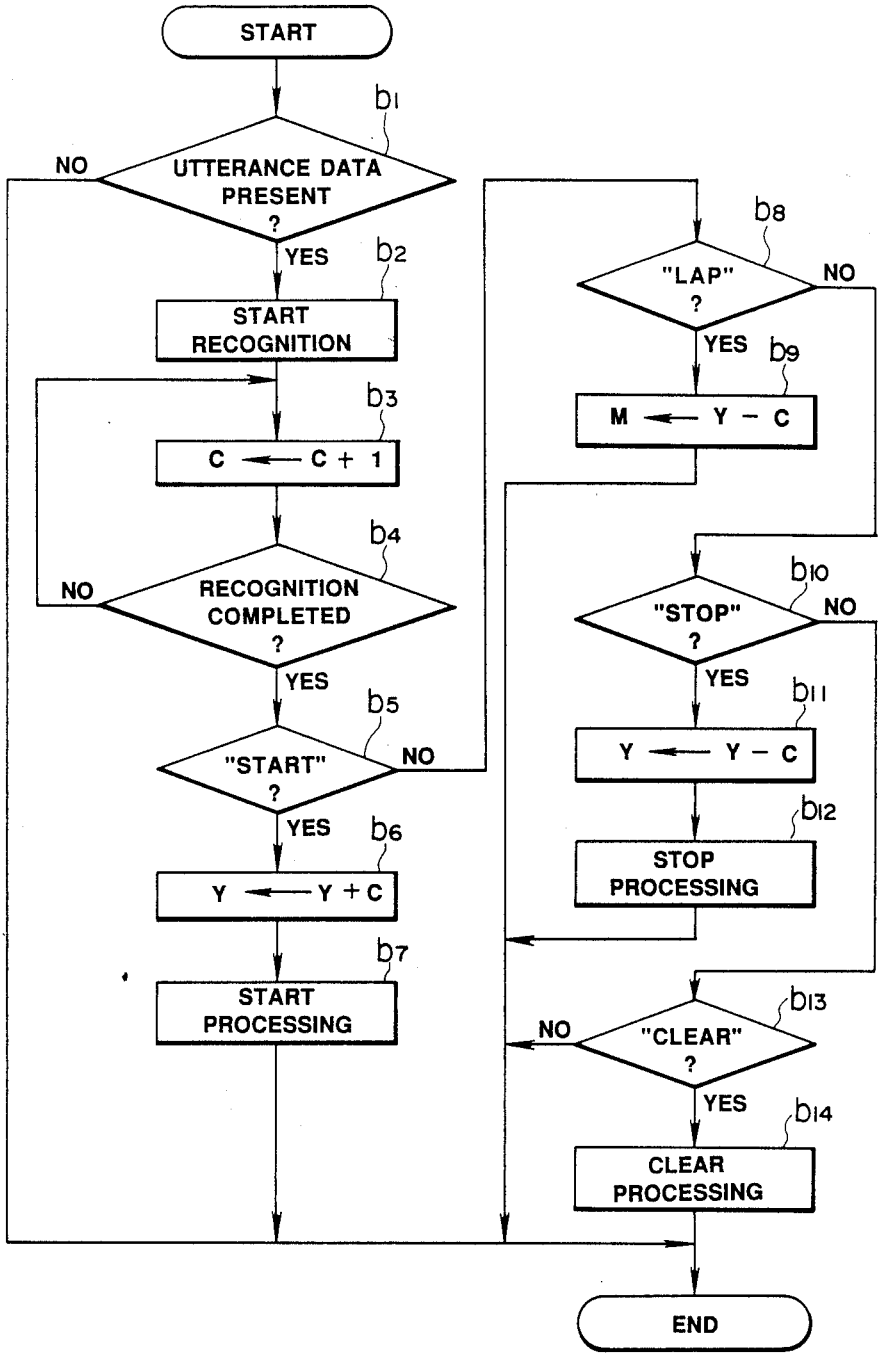
FIG. 11 is a flow chart for explaining in detail the speech processing shown in FIG. 10.

Referring to FIG. 11, whether utterance data is present is checked in step $b_1$. If the utterance data is present, the flow advances to step $b_2$, and speech recognition is started by the speech recognition unit 43 shown in FIG. 8. At the same time, in step $b_3$, the counter C shown in FIG. 9 starts counting. Counting is continuously performed until it is determined in step $b_4$ that speech recognition by the recognition unit 43 is finished. That is, the counter C counts a time interval from detection of the speech input to completion of speech recognition.

When speech recognition is finished, operations are performed in steps $b_5$, $b_8$, $b_{10}$, and $b_{13}$ to check whether the recognition result indicates "start" for starting a stopwatch operation, "lap" for writing a lap time as an elapsed time, "stop" for stopping the stopwatch operation, or "clear" for clearing measurement data, respectively. If "start" is determined in step $b_5$, the flow advances to step $b_6$, and the content of the counter C is added to the stopwatch register Y shown in FIG. 9. Thereafter, in step $b_7$, start processing is performed, i.e., the register Y is sequentially incremented by one, thereby starting time measurement processing for measuring an elapsed time interval from the start. In this case, the start processing start timing is delayed from an actual start timing (i.e., a timing at which the speech "start" is input) by a time required for speech recognition. Since this time delay is corrected by the processing in step $b_6$, however, the content in the stopwatch register Y corresponds to a correct measurement time from the actual start. For example, even if two seconds are required for speech recognition, since a delay of two seconds is added to the register Y, its content indicates a correct measurement time.

If "lap" is determined in step $b_8$, the flow advances to step $b_9$, and a value obtained by decrementing the register Y by the content of the counter C (i.e., a measurement time obtained upon speech input) is stored in a lap memory Mk (k=0, 1, 2, . . .). In this case, if the content of the register Y obtained upon completion of speech recognition is directly used as a lap time, it includes an extra time required for speech recognition. However, since the extra time is subtracted in the processing in step $b_9$, a correct lap time is obtained.

If "stop" is determined in step $b_{10}$, the flow advances to step $b_{11}$, and the register Y is decremented by the content of the counter C. Thereafter, stop processing (for stopping counting of the register Y) is performed in step $b_{12}$. In this case, if the content of the register Y obtained upon speech recognition is completed is directly used as a final elapsed time, it includes an extra time required for speech recognition as in the case of the above lap time. However, since the extra time is subtracted in the processing in step $b_{11}$, a correct elapsed time is obtained.

If "clear" is determined in step $b_{13}$, clear processing for clearing the contents of the register Y is performed in step $b_{14}$. In this case, since a time difference is not problematic, correction by the counter C need not be performed.

According to the third embodiment, as described above, the counter C counts a time interval from speech input to recognition completion (step $b_3$), and a time difference between the speech input and completion of speech recognition is corrected using the obtained count (steps $b_6$, $b_9$, and $b_{11}$). Therefore, a very correct measurement time can be obtained. As a result, a stopwatch device based on speech input is realized.

4th Embodiment

A data memory device according to a fourth embodiment of the present invention will be described below. An overall arrangement of internal circuits of this device is similar to that shown in FIG. 8 except for microprograms stored in a ROM 41 and the contents of a RAM 42.

Figure 12:
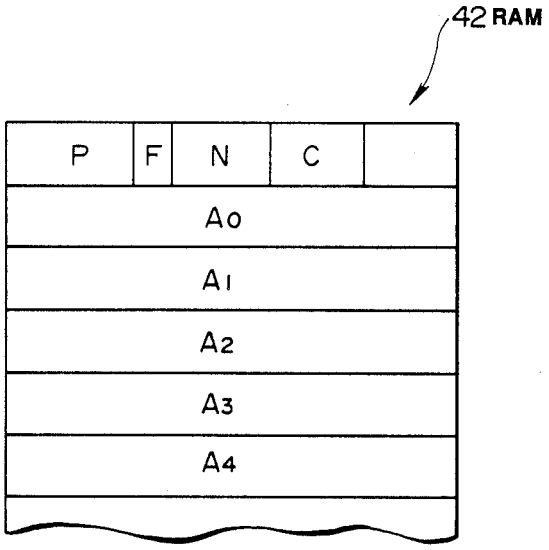
FIG. 12 is a diagram showing the contents of a RAM in a data memory device according to a fourth embodiment of the present invention.

The contents of the RAM 42 according to the fourth embodiment are shown in FIG. 12. Referring to FIG. 12, a plurality of data memories A0, A1, . . . store various data such as names, telephone numbers, and schedules. A page pointer P designates an address of one of the above data memories. "1" is written in a search flag F during data search, and "0" is written therein upon completion of search. A counter C counts a 32-Hz signal or a 32 Hz signal offset therefrom by a half period. A counter N counts a signal every 0.5 seconds.

Figure 13:
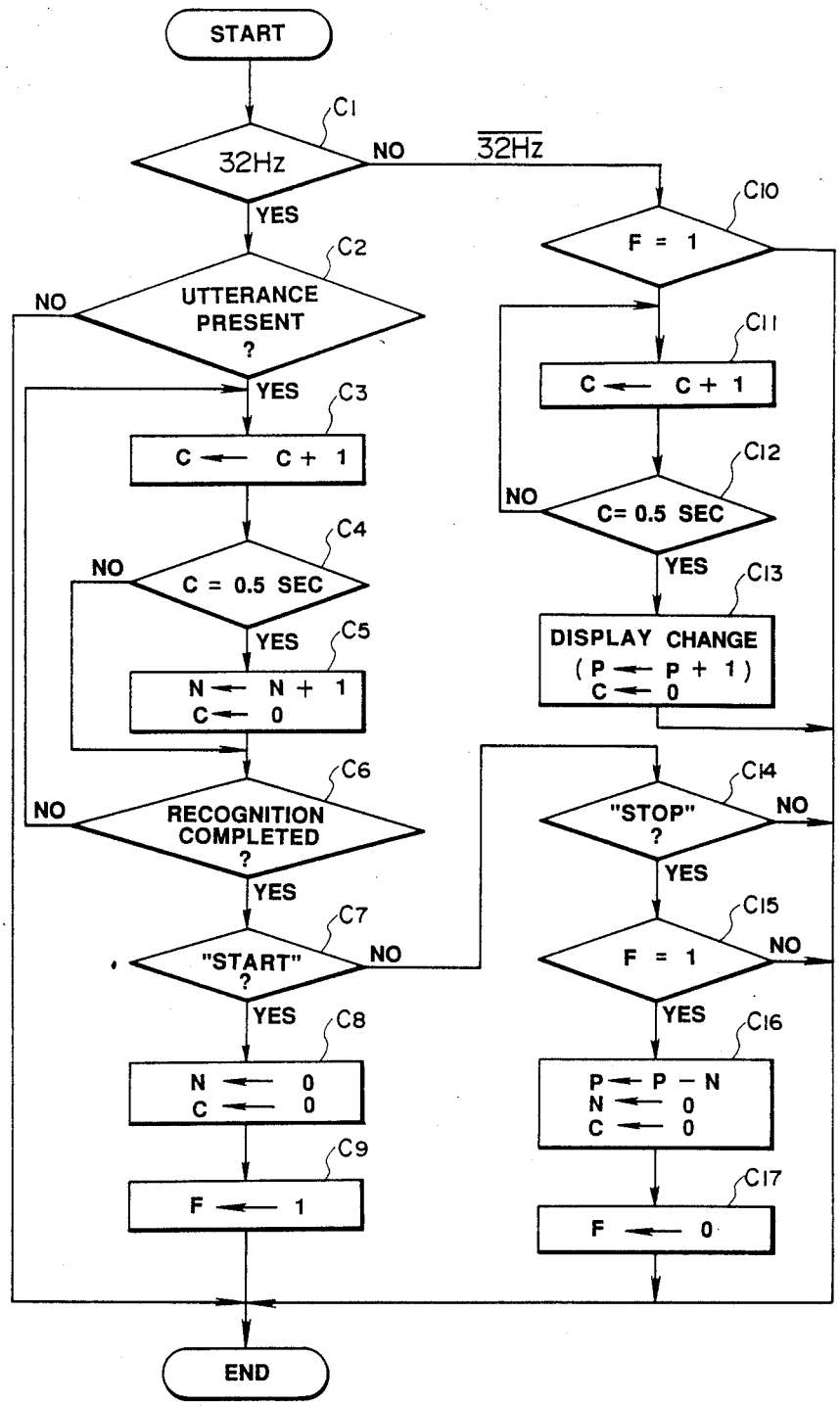
FIG. 13 is a flow chart for explaining in detail the speech processing of the embodiment shown in FIG. 12.

Speech processing upon data search according to the fourth embodiment will be described below with reference to FIG. 13.

In step $c_1$, whether a 32 Hz signal is input is checked. If the 32 Hz signal is input, the flow advances to step $c_2$. In step $c_2$, whether a speech is input is checked. If the speech is input, the counter C is incremented by one (corresponding to 1/32 sec) in step $c_3$. Subsequently, whether the content of the counter C is 0.5 sec is checked in step $c_4$. In this case, 0.5 seconds is a time interval for sequentially switching and displaying the data in the data memories A0, A1, . . . (see steps $c_{10}$ to $c_{13}$ to be described later). If the content of the counter C is 0.5 seconds, the flow advances to step c5. In step $c_5$, another counter N is incremented by one, and the content of the counter C is reset to be zero. Counting by the counter N is continuously performed until it is checked in step $c_6$ that speech recognition is completed. That is, the number of display switching times from speech input to completion of speech recognition is counted by the counter N.

Figure 14:
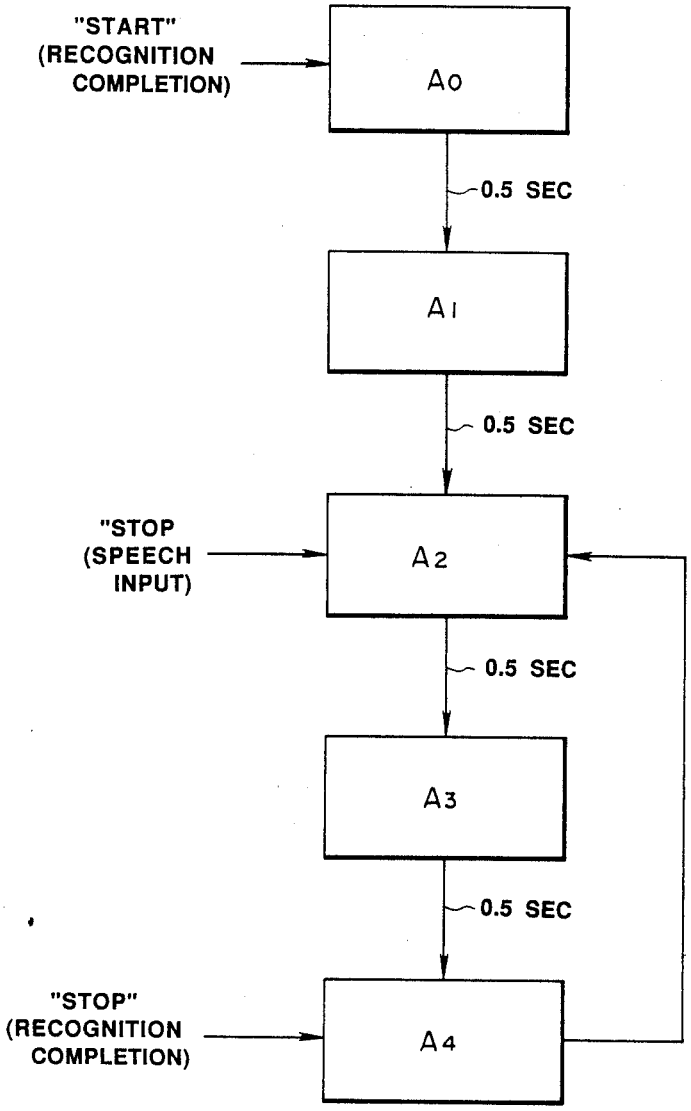
FIG. 14 is a view showing switching of display according to a speech input upon data search of the embodiment shown in FIG. 12.

When speech recognition is finished, operations are performed in steps $c_7$ and $c_{14}$ to check whether the recognition result is "start" for starting data search and whether it is "stop" for stopping data search, respectively. If "start" is determined in step $c_7$, the flow advances to step $c_8$, and the contents of the counters N and C are reset to be zero. Thereafter, "1" is written in the search flag F in step $c_9$. If such start (search start) is performed by speech input, since a time difference between speech input and completion of speech recognition is not problematic, processing for correcting the time difference need not be performed. Until the next speech is input during data search, i.e., while F is kept determined as "1" in step $c_{10}$, the counter C counts 32 Hz signals in step $c_{11}$. If it is determined in step $c_{12}$ that the content of the counter C is 0.5 seconds, display change processing is performed in step $c_{13}$. In this processing, the page pointer P is incremented by one, and the content of the counter C is reset to be zero. Therefore, during data search, the content of the pointer P is incremented by one each time the counter C counts 0.5 seconds, and the contents of the data memories A0, A1, . . . are sequentially displayed as shown in FIG. 14.

If a speech is input and "stop" is determined in step $c_{14}$, the flow advances to step $c_{15}$ to check whether the search flag F is 1 (i.e., whether data search is being performed). If F=1 in step $c_{15}$, the flow advances to step $c_{16}$. In step $c_{16}$, the pointer P is decremented by the content of the counter N, and the contents of the counters N and C are reset to be zero. Subsequently, "0" is set in the flag F in step $c_{17}$. In this case, if the content of a page designated by the pointer P upon completion of speech recognition is directly displayed, data including a time required for speech recognition is displayed. However, since the content of the counter C is subtracted from the pointer P to correct display data, a page obtained when the speech "stop" is input is finally displayed. For example, as shown in FIG. 14, when a speech "stop" is generated while the content of the data memory A2 is displayed, assume that one second is required for this speech recognition. In this case, the content of the data memory A4 two pages after the designated page is switched and displayed, but the display is finally returned to the content two pages before this temporarily displayed page. Therefore, data not having a time difference with respect to speech input is displayed.

According to the fourth embodiment of the present invention, as described above, the counter N counts the number of display switching times from speech input (step $c_5$), and a time difference between display data upon speech input and completion of speech recognition is corrected on the basis of the count (step $c_{16}$). Therefore, search can be performed at a correct timing in synchronism with speech input. As a result, a data memory device capable of searching based on speech input is realized.

The present invention can be applied to not only the above stopwatch device or data memory device but also to various instruments such as a video or sound recording device in which data to be controlled varies over time in accordance with speech input.

What is claimed is:

1. A speech recognition apparatus comprising:

time measuring means for counting reference signals to obtain measurement time information;

display means for displaying the measurement time information obtained by the time measuring means;

speech detecting means for detecting speech externally input;

measurement start control means for supplying a measurement start signal to the time measuring means in response to the detection of speech by the speech detecting means, during an interval when the time measuring means is not performing a measurement operation for obtaining the measurement time information;

measurement time information-storing means for storing the measurement time information obtained by the time measuring means in response to the detection of speech by the speech detecting means, during an interval when the time measuring means is performing the measurement operation under the control of the measurement start control means;

speech recognizing means for recognizing that the speech externally input to the speech detecting means indicates a stop command for stopping the measurement operation performed by the time measuring means; and display control means for stopping the measurement operation performed by the time measuring means in response to the recognition of an indication of a stop command by the speech recognizing means, and for causing the display means to display the measurement time information stored in the measurement time information-storing means.

2. An apparatus according to claim 1, wherein said speech detecting means comprises:

a microphone for receiving external speech and for outputting a speech signal; and utterance detecting means for detecting that the speech signal from said microphone has a sound pressure of not less than a predetermined value.

3. An apparatus according to claim 1, wherein said speech recognizing means includes:

means for recognizing speech which indicates a clear command for clearing the measurement time information of the time measuring means; and means for supplying a clear signal to the time measuring means if the speech indicating the clear command is recognized.

4. An apparatus according to claim 1, wherein said measurement time information-storing means includes a plurality of storage areas for storing the measurement time information obtained by the time measuring means.

5. An apparatus according to claim 4, further comprising read control means for sequentially reading the measurement time information out of the plurality of storage areas of the measurement time information-storing means.

6. An apparatus according to claim 5, wherein said read control means includes an externally operable switch.

7. A speech recognition apparatus comprising:

item data memory means for storing a large amount of item data including a plurality of characters;

read control means for sequentially reading the item data out of the item data memory means at predetermined time intervals;

data display means for sequentially switching and displaying the item data read out by the read control means;

speech detecting means for detecting speech externally input;

stop control means for stopping a reading operation performed by the read control means in response to the detection by the speech detecting means when the read control means is in an operating state;

speech recognizing means for recognizing whether or not the speech externally input to the speech detecting means indicates a stop command for stopping a reading operation performed by the read control means; and restart means for causing the read control means to restart a reading operation of the read control means if the speech recognizing means recognizes that the externally-input speech does not indicate the stop command.

8. An apparatus according to claim 7, wherein said speech detecting means comprises:

a microphone for receiving external speech and for outputting a speech signal; and utterance detecting means for detecting that the speech signal from the microphone has a sound pressure of not less than a predetermined value.

9. An apparatus according to claim 7, wherein said item data memory means includes:

a large number of item data memories each for storing the item data; and an address memory (P) for storing address data which designates an address of one of the item data memories;

and wherein said read control means includes means for updating the address memory at the predetermined time intervals.

10. A speech recognition apparatus comprising:

speech detecting means for detecting speech externally input;

speech recognizing means for recognizing whether the externally-input speech indicates a start command for starting a time measurement operation or a stop command for stopping the time measurement operation;

first time-measuring means (C) for starting the time measurement operation if the speech recognizing means recognizes that the externally-input speech indicates the start command, and for stopping the time measurement operation if the speech recognizing means recognizes that the externally-input speech indicates the stop command;

second time-measuring means (C) for measuring time from the detection of the externally-input speech by the speech detection means to the start of the time measurement operation, so as to obtain time data; and display means for displaying time which is obtained by adding time corresponding to the time data obtained by the second time-measuring means to measurement time obtained by the first time-measuring means.

11. An apparatus according to claim 10, wherein said speech detecting means comprises:

a microphone for receiving the external speech and for outputting an speech signal; and utterance detecting means for detecting that the speech signal from said microphone has a source pressure of not less than a predetermined value.

12. An apparatus according to claim 10, wherein said speech recognizing means includes means for recognizing speech which indicates the stop command for stopping the time measurement operation started by the first time-measuring means and for stopping the time measurement operation.

13. An apparatus according to claim 10, wherein said speech recognizing means includes:

stopping speech-recognizing means for recognizing speech which indicates a stop command for stopping the time measurement operation performed by the first time-measuring means;

third time-measuring means (c) for measuring time data corresponding to time which is required for the stopping speech-recognizing means to perform its recognition operation; and subtraction means for subtracting the time data obtained by the third time-measuring means from the time data obtained by the first time-measuring means.

14. An apparatus according to claim 13, further comprising display means for displaying time data obtained by the subtraction means.

15. An apparatus according to claim 10, wherein said speech-recognizing means includes means for recognizing speech which indicates that the time data obtained by the first time-measuring means should be stored in a memory.

16. A speech recognition apparatus comprising:

item data memory means for storing a large amount of item data including a plurality of characters;

read control means for sequentially reading the time data out of the item data memory means at predetermined time intervals;

data display means for sequentially switching and displaying the item data read out by the read control means;

speech detecting means for detecting speech externally input;

speech recognizing means for recognizing whether or not the speech externally input to the speech detecting means indicates a stop command for stopping a reading operation performed by the read control means; and stop control means for stopping a reading operation performed by the read control means when the speech recognizing means detects speech indicating the stop command when the read control means is in an operating state, said stop control means including display control means for switching the data display means to show the item data previously shown on the data display means, when the speech detecting means detects the externally-input speech.

17. An apparatus according to claim 16, wherein said speech detecting means comprises:

a microphone for receiving the external switch and for outputting a speech signal; and utterance detecting means for detecting that the speech signal from said microphone has a sound pressure of not less than a predetermined value.

18. An apparatus according to claim 6, wherein said item data memory means includes:

a large number of item data memories each for storing the item data; and an address memory (P) for storing address data which designates an address of one of the item data memories;

and wherein said read control means includes means for updating the address memory at the predetermined time intervals.

* * * * *